United States Patent [19]

Adams et al.

[11] 4,177,889

[45] Dec. 11, 1979

[54] MONEY BOX AND VAULT

[75] Inventors: Ralph D. Adams, Escondido; James K. Wyckoff, San Diego, both of Calif.

[73] Assignee: Cubic Western Data, San Diego, Calif.

[21] Appl. No.: 870,715

[22] Filed: Jan. 19, 1978

[51] Int. Cl.[2] ..... G07B 15/00

[52] U.S. Cl. ..... 194/1 B; 232/16

[58] Field of Search ..... 194/1 B, 9; 232/1 D, 232/15, 16

[56] References Cited

U.S. PATENT DOCUMENTS

Re. 28,307 1/1975 Dominick et al. ..... 232/16

FOREIGN PATENT DOCUMENTS 1331936 9/1973 United Kingdom ..... 194/1 B

*Primary Examiner*—Allen N. Knowles

*Attorney, Agent, or Firm*—Brown & Martin

[57] ABSTRACT

A coin box and vault includes a housing defining a chamber for receiving a lockable coin box. The coin box includes inner and outer relatively rotatable cylindrical housings having coin receiving openings in the sides thereof with a locking assembly for locking the housing in a position of non-alignment of the opening, a latching bracket and unlocking device is provided in the chamber for cooperatively engaging the locking assembly for unlocking the box for preventing relative rotation of the inner housing with respect to the outer housing and simultaneously locking the box assembly within the chamber.

12 Claims, 11 Drawing Figures

MONEY BOX AND VAULT

BACKGROUND OF THE INVENTION

The present invention relates to coin collection systems and pertains particularly to a lockable coin box and vault.

The collection and transportation of money such as coins and the like from coin receiving machines, and coin operated machines such as vending machines and the like has been a problem for some time. The major problem with such systems is providing a secure system for preventing pilferage and the like. While many systems have been proposed for collecting and transporting coins from vending machines and the like to central receiving or banking vaults, these systems have some drawbacks.

One approach to such collection and transportation is the collection of coins into a box which is automatically locked upon removal from the machine, and which must be transported to and inserted into a collection or banking machine in order to unlock the coin box. One drawback to such collection boxes is that they tend to jam when filled with coins thereby preventing the locking of the coin box. Another drawback to such systems is that the locking system uses a simple key for unlocking and thus can be picked.

In many such constructions the coin box comprises a cylindrical box which is rotatable within the receiving vault housing for the locking and unlocking procedure. This requires that the entire box be rotated within a housing which is sometimes difficult. Another problem with such prior art construction is that a door is provided which slides over a coin receiving opening in the housing upon rotation of the housing. Because of the construction such that the outer housing rotates relative to the door, the door can become jammed due to coins and the like.

SUMMARY AND OBJECTS OF THE INVENTION

It is therefore the primary object of the present invention to overcome the above problems of the prior art.

Another object of the present invention is to provide an improved coin handling apparatus that overcomes the above problems of the prior art.

A further object of the present invention is to provide a coin box having an improved locking means.

Another object of the present invention is to provide an improved coin box that is easily and conveniently manipulated to the locking and unlocking position.

In accordance with the primary aspect of the present invention a coin box comprises a box having inner and outer relatively rotatable housings having a coin receiving opening for alignment for receiving and discharging coins, and lock means for locking the housings in a position of non-alignment of the openings. The box which cooperates with a vault includes a box receiving chamber having locking means and unlocking means cooperative with one end of the coin box for simultaneously unlocking the housings of the box for relative rotation and for locking the box into position into the chamber and for automatically locking the housings of the box in non-alignment of the openings upon removal from the chamber.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
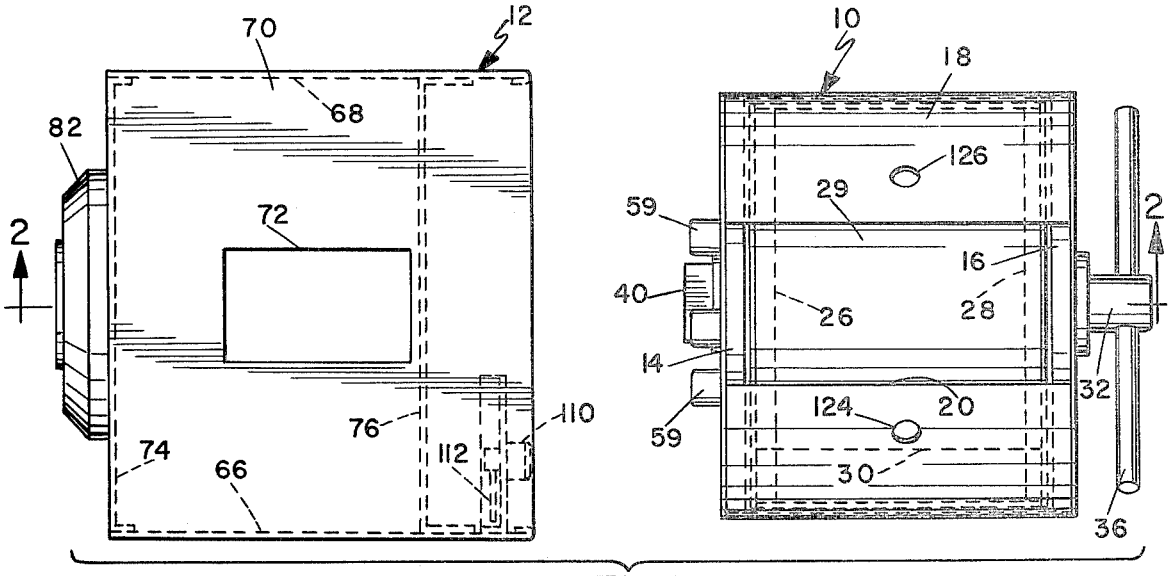
FIG. 1 is a top plan view of the coin vault and housing separated.

Turning now to the drawings, particularly to FIG. 1, there is illustrated a lockable coin box, designated generally by the numeral 10, for insertion into a vending machine or bank vault housing designated generally by the numeral 12. In accordance with the invention a coin box 10 is mounted in a vending or other coin receiving machine, now shown, within a housing such as 12 for receiving coins from the machine and transporting the coins from the machine or collection box to a central bank or collection area. The coin box 10 automatically locks upon removal from the housing of the collection box and must be returned to a similar box or the like in order to open the box for discharge of the coins therefrom.

The coin box comprises an outer cylindrical housing defined by inner and outer generally circular end walls 14 and 16 connected together by a cylindrical side wall 18. The side wall 18 terminates short of the entire circumference of the housing, thereby defining an opening 20 for receiving coins and the like. This opening is of a generally rectangular configuration and is small relative to the entire circumference of the outer housing. The end walls 14 and 16 each include coaxial cylindrical bores 22 and 24, respectively, in which an inner housing is rotatably journaled.

The inner housing comprises a pair of end walls 26 and 28 of a generally flat circular configuration, connected together by a cylindrical wall 29, thereby defining an inner cylindrical housing. An opening 30 is provided in the inner wall 29 for selective alignment with the opening 20 in the outer wall, for passage of coins and the like therethrough. The inner housing includes a shaft 32 extending through bore 24 and journaled in a bearing 34 therein. A handle 36 in the form of a rod extending through the shaft 32, provides means for applying a torque to the inner housing for rotation thereof.

Figure 10:
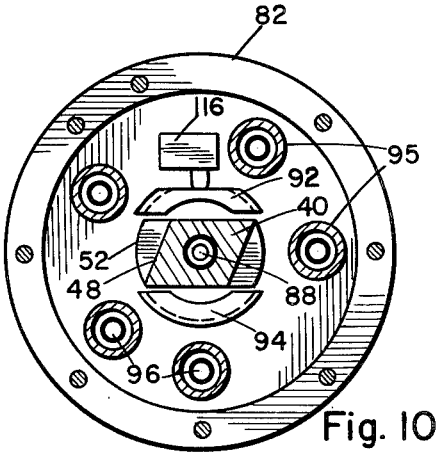
FIG. 10 is a sectional view similar to FIG. 9, but with the retaining mechanism unlocked.

A journaling and locking lug 40 is secured to the wall 26 of the inner housing such as by means of a plurality of bolts 42 and includes a journal portion 44 for rotation within bore 22. A flange 46 overlaps the wall surrounding the bore 22. The locking lug 40 includes a stop portion 48 and a pair of outer semicircular locking lugs 52, as best seen in FIG. 10. This locking lug cooperates with a locking bracket on the vault housing for locking the coin box into the vault housing during unlocking of the coin box.

Figure 2:
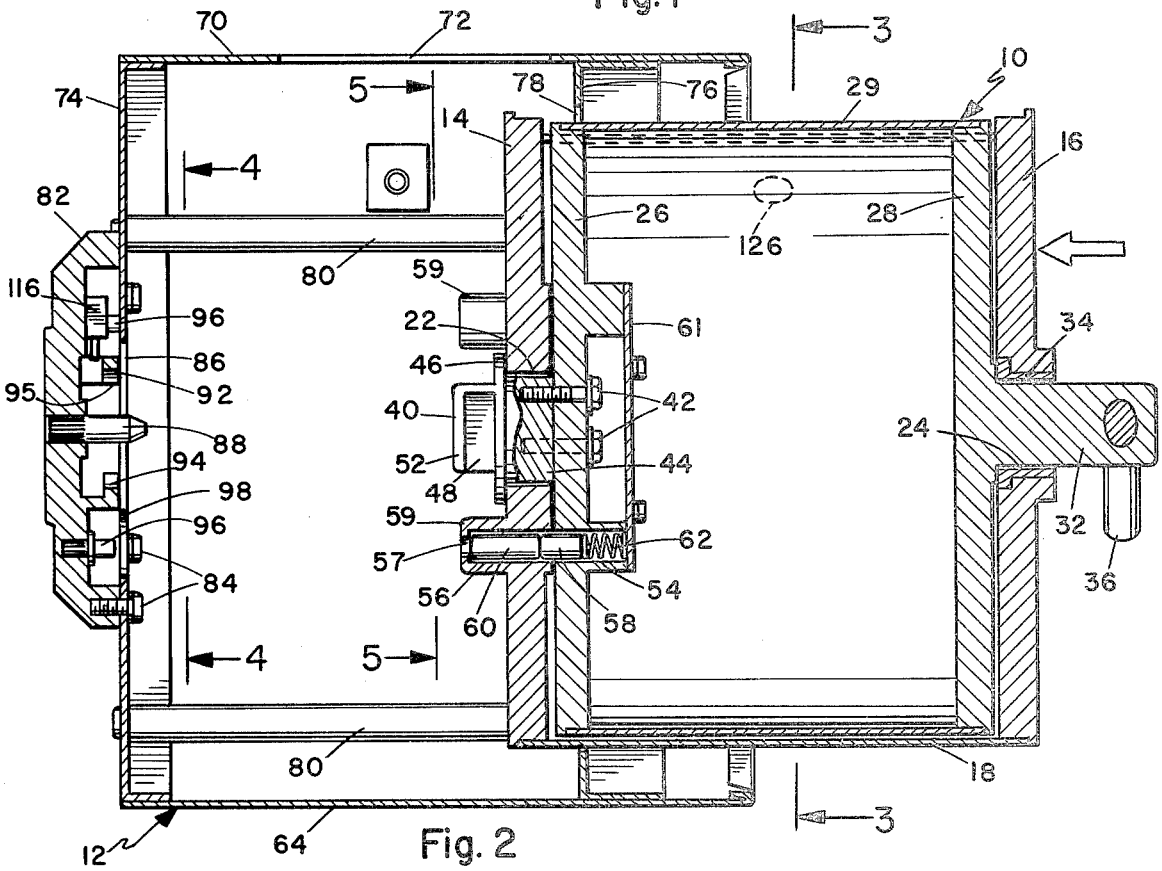
FIG. 2 is an enlarged sectional view as taken on line 2—2 of FIG. 1, with the coin vault partially inserted in the housing.

The coin box includes locking means for locking the inner housing against rotation within the outer housing. This locking means comprises a plurality of bores 54 in the inner housing that align with a plurality of bores 56 in the outer housing when the openings 20 and 30 are out of registration or alignment. A pair of locking pins or tumblers 58 and 60 are disposed within the bores and are biased by a spring 62 into a locking position as shown in FIG. 2. The springs are held in place by a cover plate 61. These tumblers or locking pins 58 and 60 are such that the pin or tumbler 60 is shorter than the bore 56, so as to permit locking tumbler 58 to slide beyond the face between the two walls 14 and 26 of the inner and outer housings. This locking pin then prevents relative rotation between the two housings. A plurality of these locking tumbler arrangements may be arranged circumferentially around the axis of the housings and the relative lengths of tumblers 60 may be altered to alter the combination. Each locking pin 60 is axially slidable in a cylindrical boss 59 projecting from wall 14. An opening 57 in the end of each box 59 permits the insertion of an unlocking pin for biasing pin 60 to the position to force locking pin 58 out of the bore 56, such that the ends of the pins 58 and 60 are aligned at the interface between walls 14 and 26 to permit rotation of the inner housing in the outer housing.

The just described coin box is adapted to fit within the housing 12 and is adapted to engage a locking bracket having key means for unlocking the locking means between the inner and outer housings. The housing 12 is of a generally boxlike construction having a bottom 64, a pair of side walls 66 and 68 and a top 70. The top 70 is provided with an opening 72 for passing coins or the like therethrough. The bottom, side and top walls are all connected to end walls 74 and 76. The end wall 76 includes a circular opening 78 for receiving the coin box 10. The end walls are further connected together by a plurality of pins 80, which also serve as guide and support means for the box 10 for passing into the housing.

Figure 7:
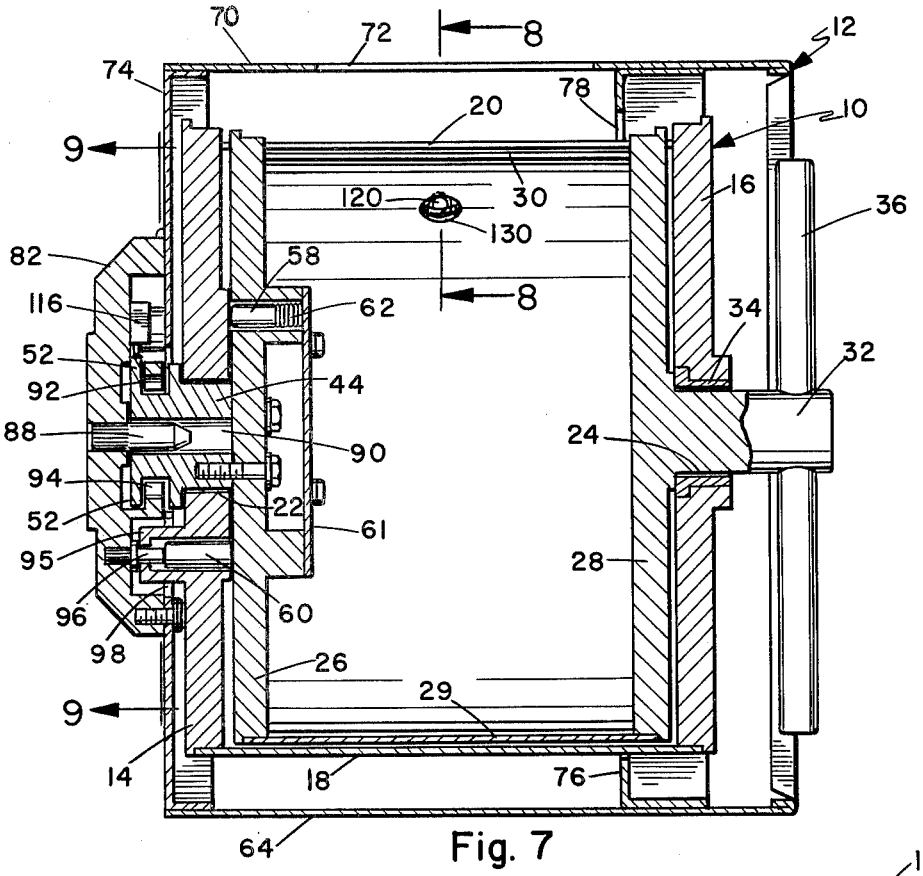
FIG. 7 is a sectional view similar to FIG. 2, but with the vault fully inserted and locked in the housing.
Figure 9:
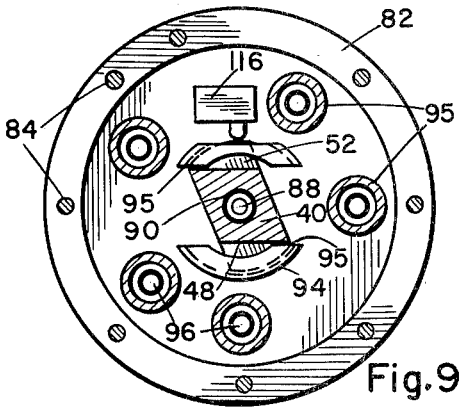
FIG. 9 is a sectional view taken on line 9—9 of FIG. 7.

A locking and unlocking bracket 82 which is secured to the end wall 74 by a suitable means such as a plurality of screws 84. The bracket is coaxial with a circular opening 86 formed in the wall 74. The bracket includes a pilot shaft 88 cooperative with a pilot bore 90 within the locking lug 40, as shown in FIGS. 7, 9 and 10. The bracket includes a pair of semicircular flange members 92 and 94 for receiving the locking lugs 52 when the coin box is rotated clockwise in the housing. The flanges also include stop surfaces 95 for cooperating with the flat stop surfaces 48. This limits rotation of the coin box within the housing. The bracket 82 also includes a plurality of unlocking pins for engaging the tumbler pins within the coin box for unlocking the lock therebetween.

Figure 4:
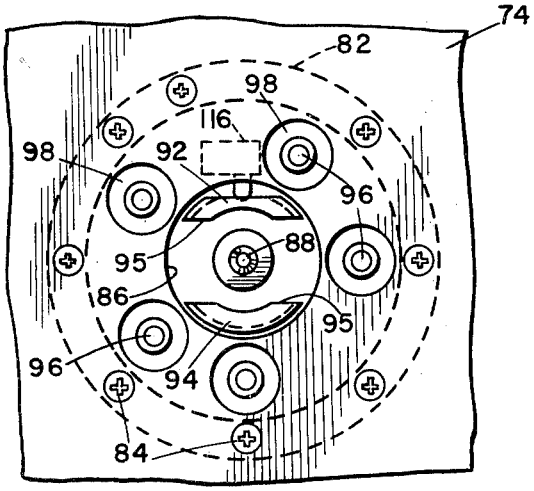
FIG. 4 is a sectional view taken on line 4—4 of FIG. 2.
Figure 5:
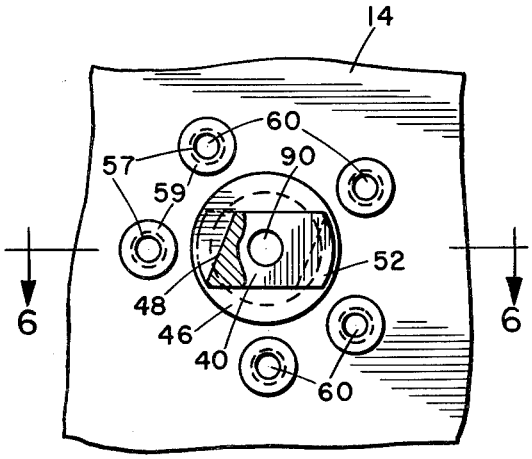
FIG. 5 is a sectional view taken on line 5—5 of FIG. 2.
Figure 6:
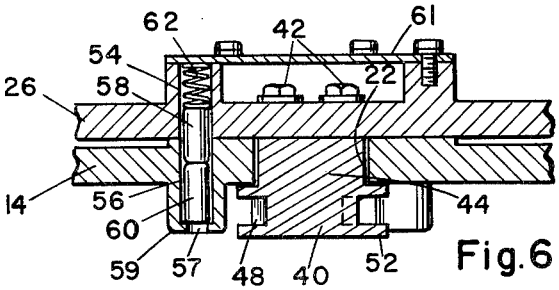
FIG. 6 is a sectional view taken on line 6—6 of FIG. 5.

As best seen in FIGS. 4 and 7, the locking and unlocking apparatus of the present invention includes a plurality of cooperating locking pins mounted in the cylindrical housings as previously described, and a plurality of unlocking pins mounted on the bracket 82 as previously described. As seen in FIG. 5, for example, the locking pins between the two rotating cylindrical housings are arranged unevenly about the axis of the housings. Alternately, they may be arranged in a uniform selective pattern. In any event, the annular arrangement can be one factor affecting the combination of the lock.

The unlocking system comprises a plurality of pins 96 which are mounted on the bracket 82 and protrude axially therefrom to fit into openings 57 and engage pins 60. End wall 74 has openings 98 concentric with pins 96 to receive the bosses 59 and so align openings 57 with the pins 96 as the coin box is inserted. The pins 96 are selected to have individual lengths which cooperate with the lengths of the pins 60 in each of the locking mechanisms to unlock the locking means. The combination of the lengths of each pin 96 and the cooperating pins 60 is equal to the distance that will be sufficient to push the end of each pin 60 to the end of the bore in wall 14, to permit rotation between the cylindrical housings, as in FIG. 7. The lengths of the unlocking pins and the tumblers can be selected to change the combination of the lock.

The housing 12 includes an additional lock for locking the coin box within the housing. This lock, indicated in FIG. 3 at 110, includes a key operated lever 112 which may be movable downward in front of the coin box when in position, such that only someone with a key to this lock cam remove the coin box 10 from the housing 12.

Figure 3:
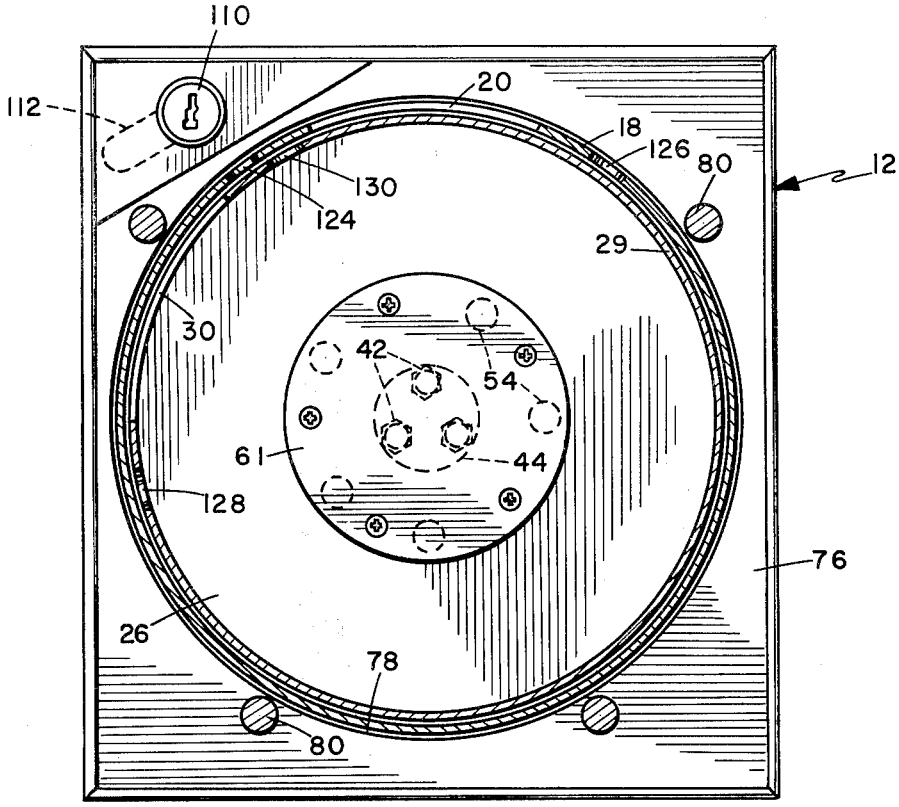
FIG. 3 is a sectional view taken on line 3—3 of FIG. 2.
Figure 8:
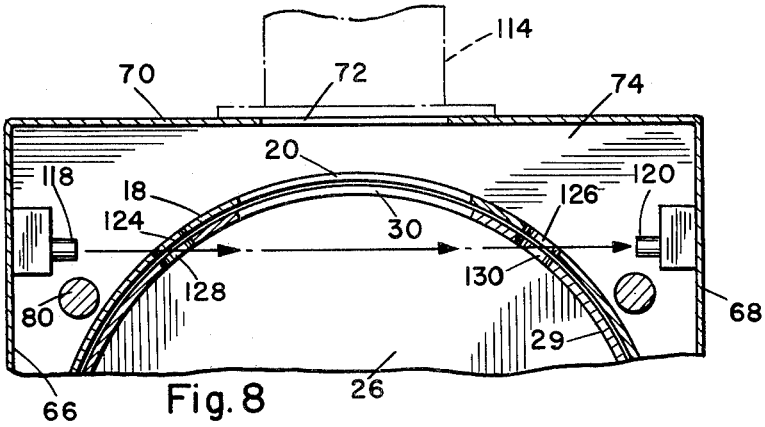
FIG. 8 is a sectional view taken on line 8—8 of FIG. 7.

The above described coin box and locking assembly may be utilized in any number of coin operated or coin receiving machines. It may also be used in other money receiving installations and may even be adapted to receive cash or bills instead of merely coins. In utilization of the apparatus the housing member or assembly 12 will be mounted in a coin or money receiving machine and the opening 72 connected to a money chute 114 as shown in FIG. 8. Preferably the machine includes an inner lock system such that the machine will not function without the presence of the coin box assembly. Additionally in the preferred arrangement the coin machine will not operate with the coin box 10 completely full. Suitable sensing circuitry may be provided for covering these features. When the money is collected in the coin operated machines it passes by way of the chute or tube 114 into the coin box 10. When the coin box is full or it is desired to remove the coins therefrom, the handle 36 is simply rotated counterclockwise for rotating the inner housing approximately 60 degrees with respect to the outer housing, as best seen in FIG. 3, for moving the opening 30 in the inner housing out of alignment with the opening 20 of the outer housing. This simultaneously rotates the lug 40 out of engagement with the bracket 82, as in FIG. 10, such that the coin box may then be removed from the housing upon unlocking of the lock 110. As soon as the coin box is moved out of engagement with the locking bracket 82 the pins 96 come out of engagement with pins 60 in the box locking assembly, thus the inner and outer housing become immediately locked against relative rotation. The coin box and its contents may then be taken to a central receiving and accounting office for accounting purposes.

In order to remove the coins as assembly including the unlocking bracket arrangement of 82 must be provided. Thus a housing assembly similar to housing 12 may be provided in the cash or money receiving station for opening and removing the coins from the coin box. In such an arrangement the housing 12 may be inverted from its former position such that upon alignment of the openings in the inner and outer housing within the housing 12 the coins will drop out of the box into a chute or opening such as 72.

With the inner housing being a full housing rotatable within the outer housing, a load of coins therein does not interfere with the rotation thereof relative to the outer housing. Thus the coin receiving opening 20 can easily be closed and opened by rotation of the inner housing. With this arrangement a simple, effective and secure coin box and vault assembly is provided.

Figure 11:
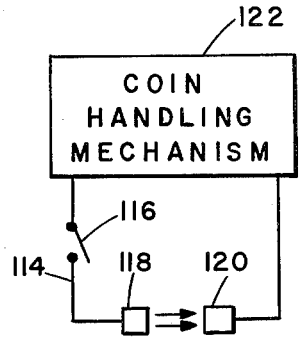
FIG. 11 is a schematic layout of the interlock circuit of the invention.

An additional feature of the invention is the provision of an interlock system that prevents the coin machine from accepting coins either (1) when the coin box is not in position, or (2) when the coin box is full. This interlock system is best illustrated in FIG. 11 and comprises an electrical circuit including a conductor 114 interrupted by a normally open switch 116 which is actuated to the closed position by rotation of the coin box into its locked position.

This circuit also includes means for sensing the level of coins above a certain level in the box considered the full level. This sensing means comprises a light emitter 118 and a light sensor 120 connected in the circuit such as in series with the switch 116. This circuit is connected into a coin handling mechanism control 122. This interlock circuit functions when broken to place the coin handling mechanism into a non-acceptance mode so that it rejects coins or the like placed in the machine. The coin handling mechanism 122 may be of any suitable type readily available on the market. The coin handling mechanism 122 is connected in the machine to receive coins and let them pass along chute 114 into the coin box 10.

In the preferred embodiment the light beam mechanism is positioned in the housing 12 as illustrated in FIG. 8 so that a light beam from light emitter 118 can be broken either by the level of coins in the box or non-alignment of a series of bores 124, 126 and 128, 130 in the outer and inner walls 18 and 29. Thus, when the coin box is either (1) full, or (2) the inner and outer housings thereof are out of coin acceptance alignment, the light beam will be broken and the machine deactivated.

The switch 116 is preferably mounted in a position as shown in FIGS. 7 through 10 within bracket 82 to be engaged and closed by one of the locking lugs 52 as the coin box is rotated into the locked position within the housing.

While the present invention has been described and illustrated by means of a specific embodiment, it is to be understood that numerous changes and modifications may be made therein without departing from the spirit and scope of the invention as defined in the appended claims.

Having described our invention, we now claim:

1. A coin box assembly for use in combination with a coin operated machine, said box comprising:

an outer cylindrical housing having co-axial bores formed in the end walls thereof and a coin opening in the side wall thereof;

an inner cylindrical housing mounted within said outer housing and having co-axial journal means journaled within said co-axial bores for relative rotation therein and a coin opening in the side wall thereof for alignment with said opening in said outer housing for the passage of coins therethrough;

lock means for locking said inner and outer housings into a locked position against relative rotation with said openings out in alignment, said lock means comprises a plurality of bores formed in adjacent walls of said inner and said outer housing, and spring biased pin means disposed in said bores and normally extending between and locking said walls against relative rotation, a vault housing having a chamber for receiving said box, and means in said chamber for simultaneously locking said box in said chamber and unlocking said inner and said outer cylindrical housings for permitting relative rotation therebetween for alignment of said coin openings.

2. The coin box assembly of claim 1, wherein said means for locking said box in said chamber comprises a bayonette type coupling between said box and a wall of said chamber.

3. The coin box assembly of claim 1, wherein said unlocking means comprises a plurality of pins in said chamber for engaging said spring biased pins in said plurality of bores for biasing said spring biased pins into a retracted position.

4. The coin box assembly of claim 1, wherein said outer housing includes concentrically disposed co-axial bores in the end walls thereof; and said inner housing includes journal means rotatably mounted in said co-axial bores.

5. The coin box of claim 3, wherein one of said journal means comprises a shaft extending beyond the end wall of said outer housing, and a handle secured to said shaft for rotating said inner housing.

6. The coin box of claim 5, wherein the other of said journal means includes semi-circular flange means for engaging bracket means in said vault housing for locking said box in said chamber.

7. The coin box of claim 6, wherein said vault housing includes a coin opening, said coin box is receivable in said chamber only with the coin opening of said outer cylindrical housing in alignment with said coin opening of said vault housing, and said flange means and bracket means permits rotation of said inner housing between said locked position and a position with the coin opening thereof in alignment with the coin opening in said outer housing.

8. A coin box assembly for use in combination with a coin operated machine, said box comprising:

an outer cylindrical housing having co-axial bores formed in the end walls thereof and a coin opening in the side wall thereof;

an inner cylindrical housing mounted within said outer housing and having co-axial journal means journaled within said co-axial bores for relative rotation therein and a coin opening in the side wall thereof for alignment with said opening in said outer housing for the passage of coins therethrough;

lock means for locking said inner and outer housings into a locked position against relative rotation with said openings out of alignment;

a vault housing having a chamber for receiving said box;

means in said chamber for simultaneously locking said box in said chamber and unlocking said inner and said outer cylindrical housings for permitting relative rotation therebetween for alignment of said coin openings; and a coin handling mechanism, and interlock means responsive to rotation of said coin box into locking position with alignment of said coin openings for activating said coin handling mechanism.

9. The coin box assembly of claim 8, wherein said interlock means includes a circuit including a switch activated by said means for locking said box in said chamber.

10. A coin box assembly for use in combination with a coin operated machine, said box comprising:

an outer cylindrical housing mounted within said outer housing and having co-axial journal means journaled within said co-axial bores for relative rotation therein, and a coin opening in the side wall thereof for alignment with said opening in said outer housing for the passage of coins therethrough;

lock means for locking said inner and outer housings into a locked position against relative rotation with said openings out of alignment;

a vault housing having a chamber for receiving said box, means in said chamber for simultaneously locking said box in said chamber and unlocking said inner and said outer cylindrical housings for permitting relative rotation therebetween for alignment of said coin openings; and a coin handling mechanism, and coin responsive means responsive to a predetermined level of coins in said box for deactivating said coin handling mechanism.

11. The coin box assembly of claim 10, wherein said coin responsive means comprises a control circuit including a light beam, said light beam located in a position to be broken by coins in said box above said predetermined level.

12. The coin box assembly of claim 11, wherein said light beam is projected through aligned opening in said inner and outer housings of said coin box adjacent to and slightly below said coin opening.

* * * * *